US006082404A

United States Patent [19]

Schulreich et al.

[11] Patent Number: 6,082,404

[45] Date of Patent: Jul. 4, 2000

[54] CLOSABLE RADIATOR GRID FOR AN ARMORED VEHICLE

[75] Inventors: Johann Schulreich, Vienna; Anton Straszgürtl, Schwadorf, both of Austria

[73] Assignee: Steyr-Daimler-Puch Aktiengesellschaft, Vienna, Australia

[21] Appl. No.: 09/081,197

[22] Filed: May 19, 1998

[30] Foreign Application Priority Data

May 23, 1997 [AT] Austria ..... 313/97 U

[51] Int. Cl.[7] ..... F16K 3/02

[52] U.S. Cl. ..... 137/625.33; 251/120

[58] Field of Search ..... 137/625.33; 251/120

[56] References Cited

U.S. PATENT DOCUMENTS

| | | | |
|---|---|---|---|
| 926,762 | 7/1909 | Petsche | 137/625.33 |
| 2,576,848 | 11/1951 | Mercier et al. | 137/625.33 |
| 2,734,529 | 2/1956 | Harrison | 137/625.33 |
| 3,312,241 | 4/1967 | Bryant | 137/625.33 |
| 4,489,756 | 12/1984 | Balz | 137/625.33 |
| 4,877,059 | 10/1989 | Popescu et al. | 137/637.1 |

FOREIGN PATENT DOCUMENTS 7421535 6/1974 Germany .

*Primary Examiner*—John Fox
*Attorney, Agent, or Firm*—Bachman & LaPointe, P.C.

[57] ABSTRACT

A closable radiator grid for an armored vehicle which comprises two frames which have a plurality of parallel plates, wherein one frame is closed with respect to the other in a partition plane transverse to the direction of the plates. In order to disturb the rate of passage of cooling air as little as possible and seal it well, the plates of the two frames are inclined, in cross section, in opposite directions by an angle, the thickness of the plates at the partition plane being greater than the width between the plates of the same frame and form a convergent-divergent flow channels in their open state between the plates of the two frames which are aligned with each other.

3 Claims, 2 Drawing Sheets

CLOSABLE RADIATOR GRID FOR AN ARMORED VEHICLE

BACKGROUND OF THE INVENTION

The present invention relates to a closable radiator grid for an armored vehicle, which comprises two frames one of which has a series of parallel plates and one frame is displaceable with respect to the other in a partial plane transverse to the direction of the plates.

In armored vehicles, the air intake for the cooling and exhaust air is generally arranged on the top of the tank. Upon the introduction into cooling water from a source in the case of a floatable armored vehicle, also by the action of a wave, the cooling air intake is overflooded. Since such quantities can no longer be controlled by the bilge pump, the grid protecting the air intake (also by bombardment) must be previously closed.

A radiator grid of this type, while not specifically for armored vehicles, is known from Federal Republic of Germany Utility Model 74 21 585. By displacement of the one frame, the plates of the two frames can be brought together, corresponding to the opened state. In this way, the free passage cross section is at most half the surface of the frame. Since the grid must also be tight in closed state, an overlap is necessary as a result of which less than half the surface is available in open state. Since a considerable throttling action is also obtained, the cooling-air passage is severely limited.

Furthermore, in the case of armored vehicles ballistic protection is also necessary, which does not permit a grid which can be screwed through, there is furthermore desired a lower structural height, for which reason also known flaps which aside from their poor sealing are also not suitable.

SUMMARY OF THE INVENTION

Accordingly, it is the principle object of the invention to provide a radiator grid which (1) interferes as little as possible with the passage of the cooling air, (2) seals well, and (3) can withstand bombardment.

In accordance with the invention, the foregoing object is obtained by the present invention wherein:

a) the plates of the two frames are inclined in cross section in opposite directions, b) the thickness of the plates is greater in the partition plane than the distance to the next plate of the same frame, and c) in open state between the plates of the two frames which are aligned with each other, convergent-divergent flow channels are formed.

By the displaceable frames, small actuation paths are established, the inclined plates reduce the structural height, and assure dependability against bombardment and the thickness of the plates in the partition plane creates the overlap necessary for the sealing. Due to the convergent-divergent flow channels, however, the geometrical reduction in cross-section leads only to a slight decrease in the passage of cooling air.

BRIEF DESCRIPTION OF THE DRAWINGS

The invention will be described below will reference to the drawings wherein.

DETAILED DESCRIPTION

Figure 1:
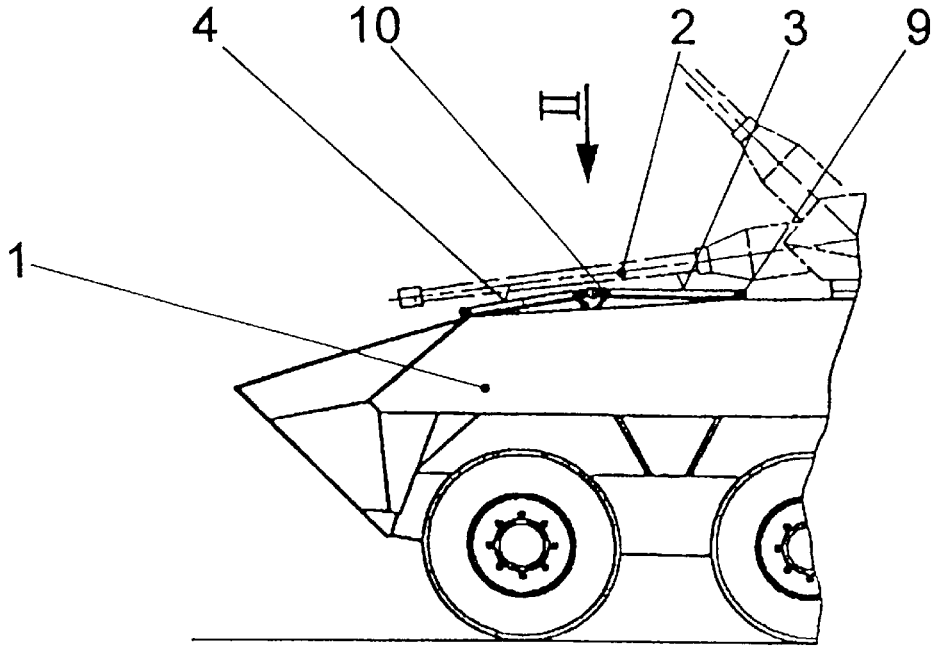
FIG. 1 is a partial side view of a wheeled armored vehicle.
Figure 2:
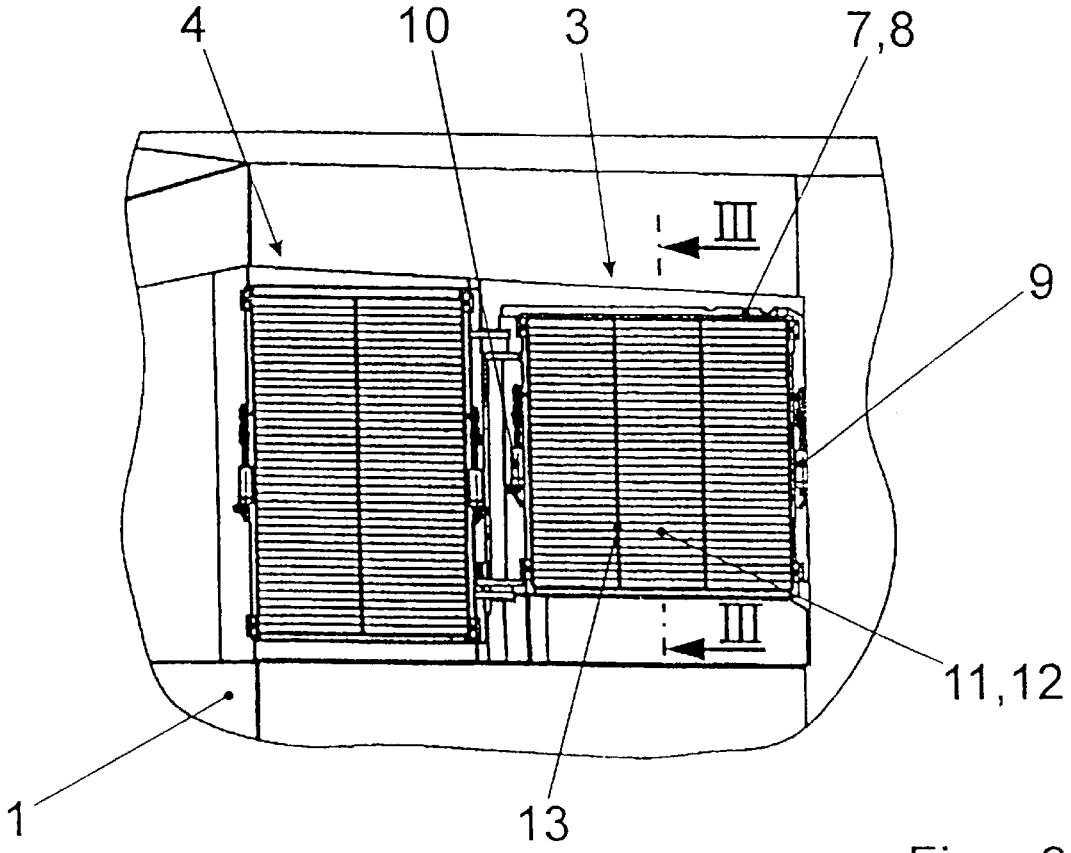
FIG. 2 is a top view along the line II in FIG. 1.

In FIGS. 1 and 2 the now partially developed tank is designated generally as 1. The gun 2 is shown in dashed line. On the top of the tank there is a radiator grid 3 and possibly another radiator grid 4. One of the two can serve as outlet for the heated cooling air. In the following, only the first radiator grid 3 will be described further.

The radiator grid 3 is formed of a first frame 7 and a second frame 8, the frame 7 being firmly connected to the tank 1, and the frame 8 being displaceable by means of fluid cylinders 9, 10 with respect to the first frames 7 in the cross-sectional direction of the vehicle. The two frames 7, 8 each contain plates 11, 12 arranged in parallel, which are connected in the event of a large length at certain distances apart by transverse plates 13.

Figure 3:
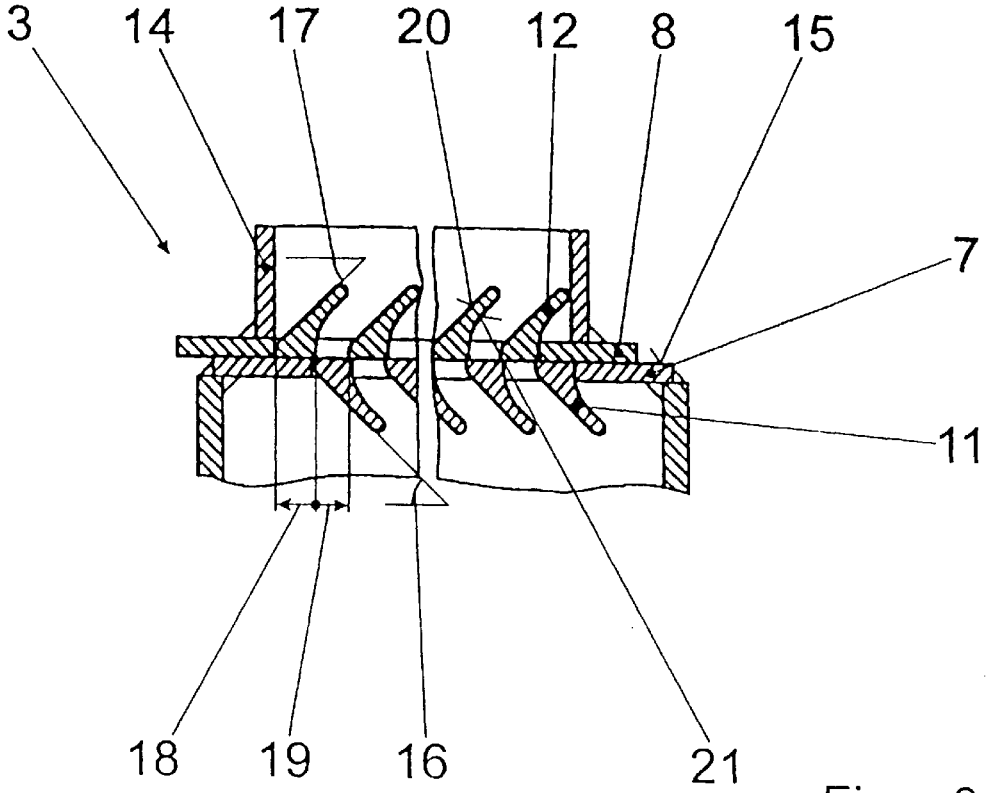
FIG. 3 is a section along the line III—III of FIG. 2, greatly enlarged and in closed position.

FIG. 3 shows the grid 3 greatly enlarged. The first frame 7 and the second frame 8 are displaceable with respect to each other along a partition plane 15. The second frame 8 also has a collar 14 for stiffening. The plates 11 which are fastened in the first frame 7 form with the partition plane 15 an angle 16 and the second plates 12 an angle 17. The thickness of the plates decrease away from the partition plane 15. The thickness 18 in the partition plane is the greatest and at the outer end the least. In this way, each plate has an approximately straight rear surface 20 inclined by the angle 16 or 17 to the partition plane 15. The distance 19 between the plates in the partition plane 15 is less than their thickness 10. From this, the sealing overlap is obtained in the closed condition shown.

Figure 4:
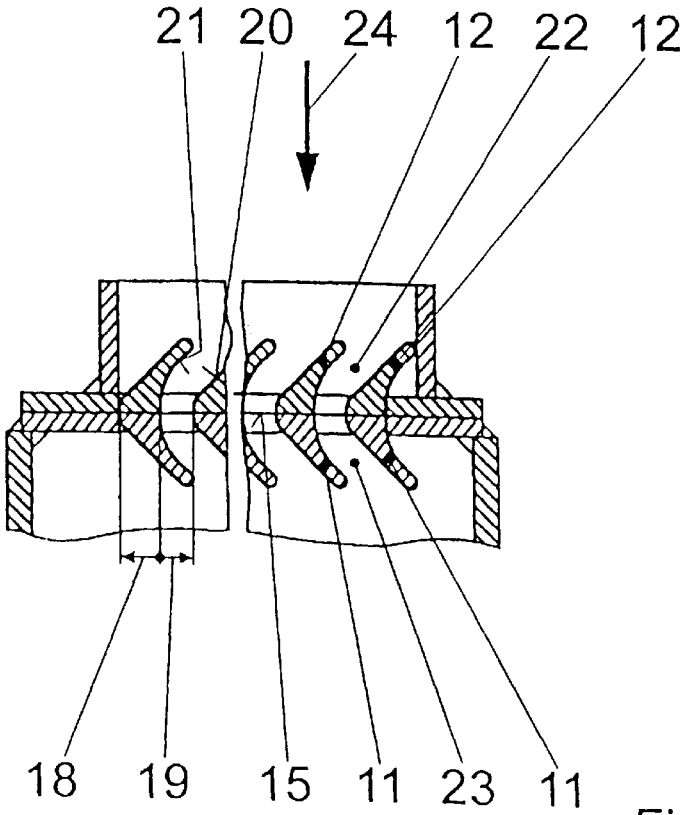
FIG. 4 is the same as FIG. 3, but in open position.

FIG. 4 shows the grid in open state. Now, every two adjacent plates 11 and 12 form a control channel which consists of a convergent part 22 and a divergent part 23 when one assumes the direction of flow 24. This shape of the flow channels has the result that the air in the convergent part is accelerated and is delayed again in the divergent part; in this way, the reduced open cross section in the partition plane 15 is compensated for by a temporary increase in speed. This shape has furthermore the advantage of controlling the deflection angle of a large radius required for ballistic reasons, so that the throttle losses are slight.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A radiator grid for a vehicle comprises a first frame and a second frame separated from each other by a partition plane, said first frame having a first row of parallel plates extending from said partition plane in a first direction and defining therebetween first channel, said second frame having a second row of parallel plates extending from said partition plane in a second direction opposite said first direction, and defining therebetween second channels, means for moving said frames selective to each other from a first position where said first channels communicate with said second channels and a second position where said first channels are substantially blocked from communication with said second channels, wherein said first direction extends at a first angle to said partition plane and said second direction extends at a second angle to said portion plane opposed to said first angle, said plates vary in thickness and have a thickness at said partition plane which is greater than the width of said first and second channels, wherein said first channels and said second channels form convergent-divergent bending flow channels when said frames are in said first position.

2. A radiator grid according to claim 1, wherein said first row of plates form, in cross section, an approximately right angle with said second row of plates.

3. A radiator grid according to claim 1, wherein said bending flow channels form an angle of about 90°.

* * * * *